United States Patent [19]

Imberg et al.

[11] 3,993,886

[45] Nov. 23, 1976

[54] SUPPLY WAVE GUIDE SYSTEM IN MICROWAVE OVENS

[75] Inventors: Bengt Uno Imberg; Kurt Håkan Karlsson; Gustav Georg Orke, all of Norrkoping, Sweden

[73] Assignee: U.S. Philips Corporation, New York, N.Y.

[22] Filed: Aug. 30, 1974

[21] Appl. No.: 502,148

[52] U.S. Cl. ..... 219/10.55 F

[51] Int. Cl.[2] ..... H05B 9/06

[58] Field of Search ..... 219/10.55 F, 10.55 R, 219/10.55 A, 10.55 M

[56] References Cited

UNITED STATES PATENTS

| | | | |
|---|---|---|---|
| 2,704,802 | 3/1955 | Blass et al. | 219/10.55 F |
| 2,748,239 | 5/1956 | Long et al. | 219/10.55 F |
| 2,814,708 | 11/1957 | Blass | 219/10.55 F |
| 2,909,635 | 10/1959 | Haagensen | 219/10.55 F |
| 3,364,332 | 1/1968 | Reftmark | 219/10.55 F |
| 3,431,381 | 3/1969 | Anderson | 219/10.55 F |
| 3,478,188 | 11/1969 | White | 219/10.55 A |
| 3,789,179 | 1/1974 | Haagensen | 219/10.55 F |
| 3,872,276 | 3/1975 | Corcoran et al. | 219/10.55 F |

FOREIGN PATENTS OR APPLICATIONS

| | | | |
|---|---|---|---|
| 1,378,280 | 10/1964 | France | 219/10.55 F |
| 32,474 | 12/1966 | Japan | 219/10.55 F |

*Primary Examiner*—Bruce A. Reynolds
*Attorney, Agent, or Firm*—Frank R. Trifari

[57] ABSTRACT

A supply wave guide system for microwave ovens consists of a wave guide of constant height and continuously varying width, which wave guide is terminated at the wider end by a short-circuiting wall. Microwave energy is fed into the wave guide at its smaller end. Microwave energy is fed from the waveguide into the oven cavity through at least two coupling apertures situated at the wider part of the wave guide and leading directly into the cavity, in which apertures stirrers, preferably movable and in the shape of rotating metallic wings, are situated.

16 Claims, 5 Drawing Figures

SUPPLY WAVE GUIDE SYSTEM IN MICROWAVE OVENS

Figure 1:
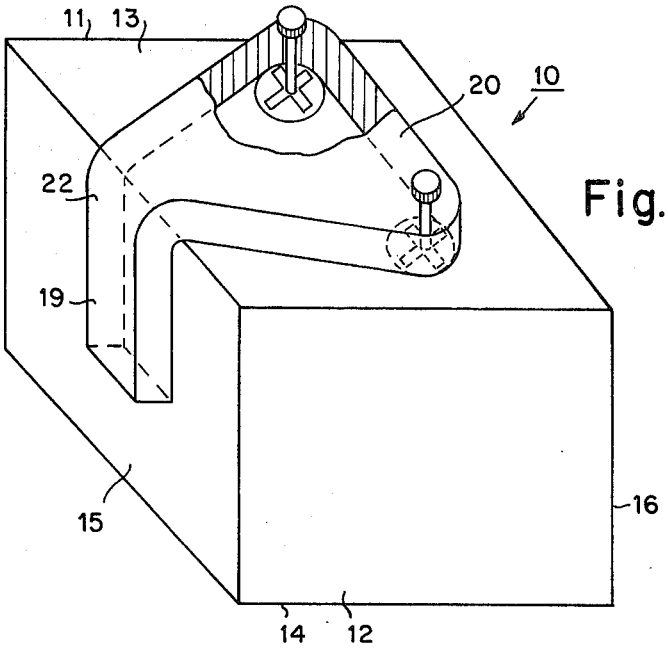

The invention relates to a supply wave guide system for connecting the coupling antenna of a magnetron to an oven cavity in a microwave oven.

A commonly used supply wave guide system in microwave ovens consists of a wave guide which is divided into two branches each terminating in its own coupling aperture. Without special measures it has, however, turned out that the field distribution within the cavity for such a supply system will be unsatisfactory. It has therefore been necessary to use large rotating stirrers situated in front of the feeding apertures within the oven cavity, which stirrers on the one hand serve to throw energy in different directions and on the other hand to vary the resonance conditions within the cavity. In spite of this the field distribution, under certain operation conditions, can still be unsatisfactory.

In another known supply system a wave guide having the same width as the cavity extends along one or more side walls of the cavity so that the supply of energy into the cavity is effected through a large number of slits which connect the cavity with the wave guide. By means of this "slit supply" at one or more side walls of the cavity an improved field distribution in the cavity is achieved. In order to further improve the field distribution in the known oven construction, periodically adjustable metallic bodies are arranged within the wave guide in the vicinity of the magnetron antenna.

An object of the invention is to produce a supply wave guide system for microwave ovens which is more simple and less bulky than known constructions, easy and cheap to manufacture but which in spite of this will provide an improved field distribution in the oven.

According to the invention the wave guide system comprises a wave guide having constant height and continuously varying width, which wave guide at its wider end is terminated by a short-circuiting wall. The energy from the magnetron is fed into the smaller end of the wave guide and at least two coupling apertures, leading directly into the oven cavity, are arranged at the wider portion of the wave guide in one of those side walls, the width of which varies.

It has been proved that the field distribution in an oven having such a supply wave guide system will be quite satisfactory even without movable parts in the cavity or in the wave guide. A basic reason for this favorable result is that many oscillation modes are present already in the wave guide. If then all these modes are fed into the cavity this will contribute to the favorable field distribution.

In addition, because of the continuous variation of the width of the wave guide the characteristic impedance for the wave guide will be varied progressively, so that a good impedance match between the magnetron and oven cavity is achieved. Furthermore it is easy to adjust the matching by a displacement of the apertures relative to the wave guide corners at the said short-circuiting wall, or by placing a post at a suitable place.

According to another feature of the invention the coupling apertures can be placed unsymmetrically, as seen from the cavity, which will counteract the tendency for field maxima to arise in the cavity and will thus contribute to a favorable field distribution.

Even if the field distribution is quite satisfactory by merely providing such a shape of the wave guide system, as described above, a certain improvement can, however, be achieved if, according to another feature of the invention, a stirrer in the shape of a mechanically adjustable metallic body is placed in at least one of the coupling apertures, suitably a stirrer in each coupling aperture. The outer circumferential dimensions of the adjustable body or stirrer are smaller than those of the aperture so that the stirrer can protrude through the aperture slightly into the oven cavity. Since the height dimensions of the stirrer are normally greater than the oven wall thickness, the stirrer may therefore protrude through the aperture into the oven cavity and at the same time into the feed waveguide proper. Alternatively, the stirrer may be located within the aperture so that the lowest part thereof does not protrude at all into the oven cavity, in which case it will extend into the waveguide to a slightly greater extent. The stirrer also may be situated entirely within the waveguide at a point directly above and confronting the aperture. When the stirrers are adjusted cyclically in time, for example rotated, this will have two effects. On the one hand the impedance and the phase as seen from the magnetron is varied, whereby a frequency variation will arise, resulting in a variation in the field maxima in the cavity, if any, with time. On the other hand the microwave energy is reflected against the stirrers into the cavity and if the stirrers consist of obliquely set rotating wings, the energy will be reflected in different directions during the rotation.

It is also possible to let one of the stirrers stand still and to adjust its position such that an optimum field distribution is achieved, which can be effected individually. The combination of all this produces a very smooth field distribution in the oven cavity.

As a result of the location of the stirrers in the coupling apertures, they do not have any influence on the cavity space. If the stirrers are situated with their lowest part immediately above the cavity top surface, the coupling apertures may be covered by a flat disk which is transparent to microwave energy. The wave guide system is also very simple to manufacture by welding together pieces made by deep drawing.

Figure 2:
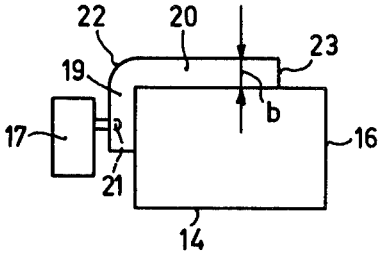
Figure 3:
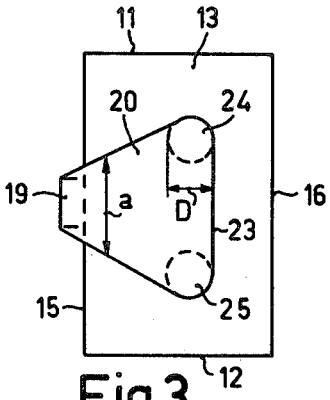
Figure 4:
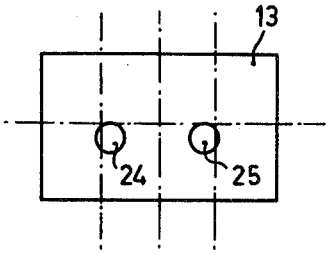
Figure 5:
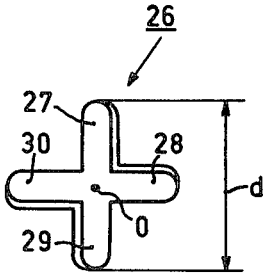

The invention is illustrated in the accompanying drawing, in which:

FIG. 1 shows a schematic perspective view of an oven cavity with a supply wave guide system according to the invention, FIG. 2 shows an end view of the device according to FIG. 1, FIG. 3 shows a plan view as seen from the top of the same device, FIG. 4 shows a schematic view of the cavity top wall for illustrating a suitable positioning of the coupling apertures, and FIG. 5 shows a plan view of a suitable embodiment of a stirrer.

FIGS. 1–3 show schematically an oven cavity 10 defined by side walls 11–15 and a door 16. The cavity is fed from a magnetron 17 (FIG. 2) through a wave guide system consisting of a rear wave guide 19 and an upper wave guide 20. The rear wave guide 19 is a rectangular standard wave guide to the broad side of which the magnetron 17 is connected in a manner such that the coupling antenna 21 thereof projects into the wave guide. The upper wave guide 20, having in each section, like the rear wave guide 19, a rectangular shape, has according to the invention a continuously — in the shown example linearly — varying width *a* so that the two broad side walls are triangular shaped, while the height *b* of the wave guide is constant. The smaller end of the wave guide 20 is connected to the rear wave guide 19 through an E-bend 22. A short-circuiting wall 23 terminates the wave guide 20 at its wider end. At the corners of the wave guide 20 there are coupling apertures 24, 25 which connect the wave guide to the inside of the cavity.

And finally, as will be described in more detail in the following description there are field stirrers arranged in the coupling apertures.

In operation energy is fed from the magnetron 17 directly into the rear wave guide 19, which energy propagates through the E-bend to the smaller end of the upper wave guide 20. Due to the fact that the width *a* of this wave guide increases successively in the direction away from the magnetron several, oscillation modes will arise in this wave guide resulting in a complicated field pattern in the wave guide. In one embodiment the dimensioning is such that the modes $TE_{10}$, $TE_{20}$, $TE_{30}$, $TE_{40}$ and $TE_{50}$ can exist in the widest portion of the wave guide. When all these modes are fed into the cavity through the coupling apertures the field distribution in the cavity will be smoothed.

In the example shown, the coupling apertures are situated exactly in the corners of the upper wave guide 20. The apertures can be situated at a distance of up to $\lambda_g/4$ from the wave guide corners for achieving correct matching to the magnetron.

For the purpose of improving the field distribution in the oven cavity the apertures may be located unsymmetrically as seen from the cavity, as shown schematically in FIG. 4. As a result possible field maxima in the cavity are suppressed.

For further improving the field distribution in the cavity, stirrers are placed in the coupling apertures. A suitable shape for these stirrers is shown in FIG. 5. The stirrer 26 consists, according to this Figure, of a body comprising four oblique wings 27, 28, 29 and 30, which can rotate about a centre 0. The edge of each wing shown in the drawing with double lines is situated in a higher plane than the opposite edge. The dimensioning is such that the outer diameter *d* is smaller than the diameter D of the coupling apertures 24, 25. Such a stirrer is placed in each coupling aperture with its center for example situated in the center of the coupling aperture. The lowest part of each stirrer can be situated immediately above the cavity wall. Thus it will be possible to cover the coupling aperture with a flat disk which is transparent to microwave energy. In operation the stirrers are made to rotate continuously. If desired the stirrer center can also be displaced in relation to the aperture center in order to achieve a greater variation.

The stirrers have the effect on the one hand to vary the impedance and phase as seen from the magnetron resulting in a frequency variation with time, and on the other hand to reflect energy in different directions into the cavity. If desired one of the stirrers can be stationary, the position of this stirrer being pre-adjusted so that the best field distribution is achieved.

Both wave guides can be manufactured by welding together pieces of deep drawn sheet material. The shape of the wave guide makes for a simple welding operation. It is for example possible to weld the wave guides directly onto the cavity or to weld pieces together so that a complete wave guide is formed, which is thereafter screwed or riveted onto the cavity. In large scale manufacturing the wave guides can be made by die-casting. In combination with the small dimensions and the simplicity of the stirrers, all this provides a wave guide system which as a whole, will be very cheap to manufacture.

A number of modifications of the described embodiment are possible within the scope of the invention. Thus, for example, the rectangular standard wave guide can be situated in the same plane as the wave guide with varying width, the E-bend thus being superfluous. According to a further alternative the rectangular standard wave guide can be omitted. The magnetron then is arranged to feed energy directly into the small end of the flared wave guide. The triangular shape of the upper wave guide can also be replaced by another shape involving an increase of the width of the wave guide according to a suitable function. The coupling apertures can be more than two and placed differently. However, it is preferable that at least one of the apertures be situated close to a corner of the wave guide with varying width. Instead of circular apertures these apertures may also be rectangular or triangular or have any other shape with the largest dimension exceeding $\lambda/2$. Finally, it may be observed that the following dimensions were used in a practical embodiment of the wave guide system according to the invention:

| | |
|---|---|
| Wave guide (20) | |
| Height (b) | 43 mm |
| Width, minimum ($a_{min}$) | 90 mm |
| Width, maximum ($a_{max}$) | 334.5 mm |
| Length | 283 mm |
| Radius of curvature at the widest end | 51 mm |
| Outcoupling apertures (24, 25) | |
| Diameter (D) | 100 mm |
| Cavity wall (13) comprising outcoupling apertures | |
| Width | 535 mm |
| Depth | 352 mm |
| Distance of center of outcoupling apertures to rear cavity wall | 183.5 mm |
| Distance of center of outcoupling apertures to left and right hand cavity side walls | 152.5 mm |

What is claimed is:

1. A microwave oven comprising, a metallic wall structure defining an oven heating cavity, a flared waveguide for coupling microwave energy from an external source of microwave energy to the oven cavity and having a constant height and a pair of opposed side walls of continuously varying width and terminated at its wider end by a short-circuiting wall, means for supplying the energy from said energy source to the small end of the flared waveguide, and at least two energy coupling apertures located in one of said side walls at the wider portion thereof and leading directly into the oven cavity.

2. A microwave oven as claimed in claim 1 wherein at least one of the coupling apertures is situated in the vicinity of a corner of the wave guide near said short-circuiting wall.

3. A microwave oven as claimed in claim 1 wherein the coupling apertures are situated unsymmetrically in relation to the lines of symmetry of the oven cavity wall through which they extend.

4. A microwave oven as claimed in claim 1 further comprising a rotatable metallic field stirrer arranged and dimensioned to fit in at least one of the coupling apertures.

5. A microwave oven as claimed in claim 1 further comprising a rotatable field stirrer positioned in one of the coupling apertures and comprising a plurality of blades inclined obliquely in relation to the plane of the coupling apertures and rotatable about an axis which is substantially perpendicular to said plane.

6. A microwave oven as claimed in claim 1 further comprising an adjustable field stirrer located in each coupling aperture, one of said stirrers being adjusted to a fixed position in which optimal impedance matching and field distribution is achieved and the other being rotatable.

7. A microwave oven as claimed in claim 1 wherein said energy supplying means includes a rectangular waveguide coupled to the small end of the flared waveguide and having dimensions corresponding to the dimensions of said small end to form a continuous waveguide path therewith, the energy from the source of microwave energy being supplied to the rectangular waveguide, and wherein the dimensions of said two apertures are small relative to the width of the waveguide at its wider end, said apertures being located at points within a distance of $\lambda/4$ of the wide end corners of the waveguide, where $\lambda$ is the wavelength of the microwave energy in the waveguide.

8. A microwave oven comprising a metallic wall structure defining an oven heating cavity, a flared waveguide having its small end coupled to a source of microwave energy for coupling said microwave energy to the oven heating cavity, said flared waveguide comprising first and second parallel opposed side walls having a continuously varying width and terminated at the wide end of the flared waveguide by a short-circuiting wall arranged perpendicular to said first and second walls and to the direction of energy propagation in the flared waveguide thereby to set up a standing wave pattern in the waveguide, one of said side walls being located adjacent an apertured wall of the oven cavity through which the microwave energy enters the oven cavity, said one side wall having first and second energy coupling apertures situated in the vicinity of the short-circuiting wall and leading directly into the oven cavity via the oven wall aperture for coupling the microwave energy to said oven cavity.

9. A microwave oven as claimed in claim 8 wherein said first and second coupling apertures are located in the vicinity of respective corners of the waveguide near the short-circuiting wall.

10. A microwave oven as claimed in claim 8 further comprising a rotatable field stirrer located in the waveguide adjacent to and confronting at least one of said coupling apertures.

11. A microwave oven as claimed in claim 10 wherein said field stirrer comprises a plurality of inclined blades rotatable about an axis perpendicular to said one side wall of the waveguide and having dimensions smaller than the one aperture so that the outer circumference of the stirrer fits within said one aperture.

12. A microwave oven as claimed in claim 8 further comprising first and second adjustable field stirrers positioned in the waveguide adjacent to and confronting said first and second coupling apertures, respectively.

13. A microwave oven as claimed in claim 12 wherein said first field stirrer comprises a plurality of inclined blades cyclically movable in time.

14. A microwave oven as claimed in claim 12 wherein said first and second field stirrers each comprise a plurality of inclined blades rotatable about an axis perpendicular to said one side wall of the waveguide.

15. A microwave oven as claimed in claim 12 wherein the first field stirrer is adjustable to a fixed position and the second field stirrer is rotatable about a given axis.

16. A microwave oven as claimed in claim 8 further comprising a magnetron coupled to the small end of the flared waveguide, and wherein the short-circuiting wall comprises an unbroken conductive wall entirely closing the wide end of the flared waveguide.

* * * * *